United States Patent [19]

Jones

[11] 3,958,116

[45] May 18, 1976

[54] LUMINAIRE RING LOWERING MECHANISM

[76] Inventor: Clifton E. Jones, 1710 Welch Blvd., Flint, Mich. 48504

[22] Filed: Sept. 27, 1973

[21] Appl. No.: 401,290

[52] U.S. Cl. ..... 240/67

[51] Int. Cl.[2] ..... F21V 21/16

[58] Field of Search..... 254/148, 175.3, 143, 254/144, 139 R; 240/67, 69, 84, 88, 63; 248/320; 187/20, 19, 17

[56] References Cited

UNITED STATES PATENTS

| | | | |
|---|---|---|---|
| 2,399,312 | 4/1946 | Augustine | 254/148 |
| 2,835,345 | 5/1958 | Beck | 187/17 |
| 3,042,375 | 7/1962 | Fahey et al. | 254/174 |
| 3,554,491 | 1/1971 | Tegtmeier | 254/148 |
| 3,586,270 | 6/1971 | Loffler et al. | 240/67 |
| 3,645,519 | 2/1972 | Schwarz et al. | 254/144 |
| 3,686,498 | 8/1972 | Meyer | 240/69 |
| 3,796,285 | 3/1974 | Grebenstein | 187/20 |

*Primary Examiner*—Robert J. Spar
*Assistant Examiner*—Kenneth Noland
*Attorney, Agent, or Firm*—Miller, Morriss, Pappas & McLeod

[57] ABSTRACT

A pole shaft is provided with continuous loop drive chain means to raise and lower a luminaire ring assembly mounted thereon. A detachable fixed head assembly is provided at the top of the pole shaft and has locating and locking means for fixedly retaining the luminaire ring in its fully raised position. The detachable fixed head assembly is provided with radially extending support arms having sheaves which support lifting and lowering suspension cables that engage the luminaire ring. The suspension cables extend inside the pole shaft and operatively engage a transition plate provided in association with the continuous loop drive chain means. A motor drive assembly is provided in the base of the pole shaft which operates the continuous loop drive chain means and associated limit switch positioning means which control the amount of travel of the continuous loop drive chain. A safety lock assembly is provided on said transition plate so as to selectively engage a safety cable provided in the pole shaft in the event of failure of the continuous loop drive chain.

9 Claims, 9 Drawing Figures

FIG.6
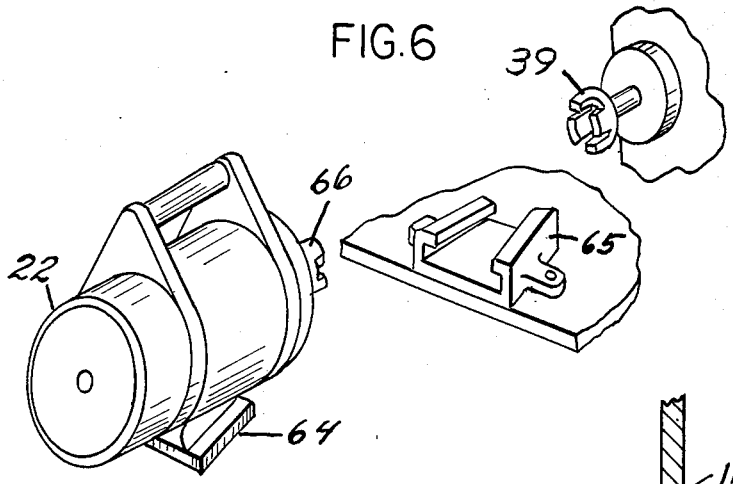
FIG.7
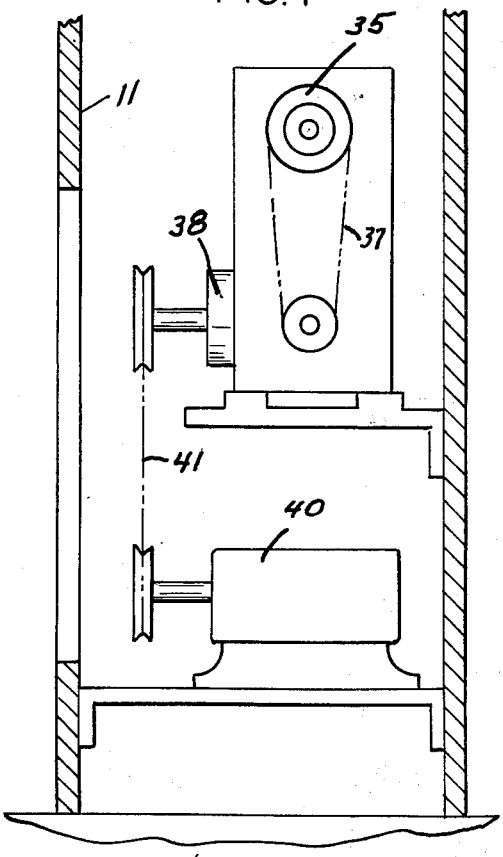
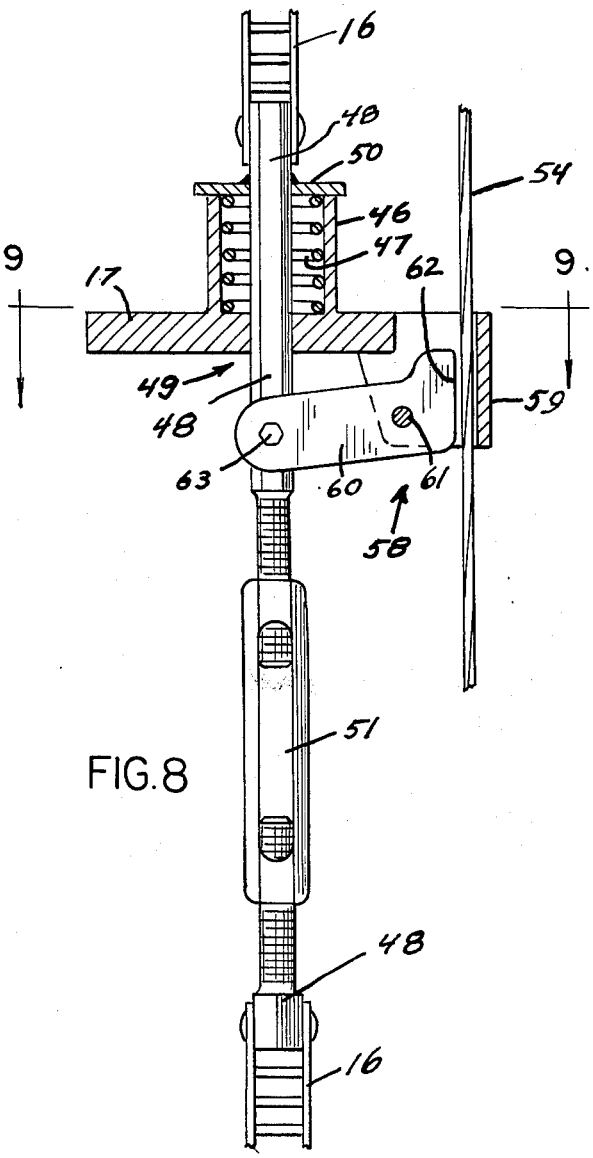
FIG.8
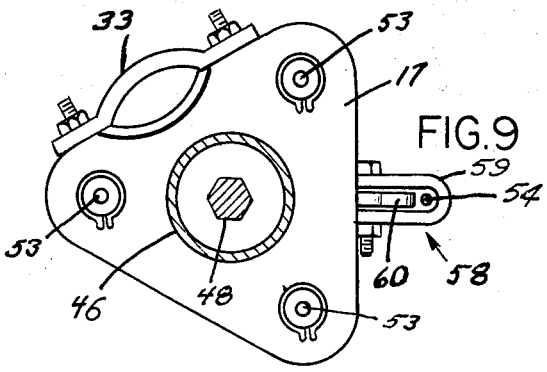
FIG.9

LUMINAIRE RING LOWERING MECHANISM

SUMMARY OF THE INVENTION

The invention relates to a pole shaft which is provided with a luminaire ring that is easily raised and lowered by use of suspension cables which are operatively connected to a continuous loop drive chain means through a transition plate assembly provided in association therewith.

A detachable fixed head assembly is provided at the top of the pole shaft and has locating and locking means for fixedly retaining the luminaire ring in its fully raised position. The detachable fixed head assembly is provided with radially extending support arms having sheaves which operatively engage the lifting and lowering suspension cables attached to the luminaire ring.

A motor drive assembly is provided in the base of the pole shaft for actuating the continuous loop drive chain and associated limit switch positioning means which determines the distance of travel of the continuous loop drive chain. The motor drive assembly includes a gear reducer for obtaining self-locking in both the raising and lowering operations. The motor drive assembly includes a built-in motor drive means or can be adapted to engage an external portable motor drive means.

A safety lock assembly is provided in association with the transition plate assembly so as to selectively engage a safety cable provided along the interior of the pole shaft.

PRIOR ART

The devices of the prior art which involve towers with remote light fixtures that can be raised and lowered are generally provided with complicated winch and cable systems and with expensive counterweight assemblies.

Representative of the prior art patents with pole or tower light systems are the devices of Meyer U.S. Pat. No. 3,686,498, Millerbernd U.S. Pat. No. 3,670,159, Pfaff U.S. Pat. No. 3,610,584, Hogan U.S. Pat. No. 3,541,325, Pfaff, Jr. U.S. Pat. No. 3,292,322, Saisset U.S. Pat. No. 283,581 and Moyer U.S. Pat. No. 2,823,302. Other types of prior art devices involving movable light fixtures are described in Hixon U.S. Pat. No. 1,788,056, Moran U.S. Pat. No. 1,633,344, Garrecht U.S Pat. No. 1,095,844, Burnham U.S. Pat. No. 960,269, Haney U.S. Pat. No. 586,435, Shank U.S. Pat. No. 456,859, and Reinhold U.S. Pat. No. 147,170.

Nowhere in the prior art is there found a device such as the invention disclosed herein whereby a pole shaft is provided with a luminaire ring assembly that is easily raised and lowered by use of suspension cables which are operatively connected to a continuous loop drive chain means so as to eliminate the need for complicated and expensive winch and counterweight systems.

Further, none of the prior art devices are provided with a detachable fixed head assembly at the top thereof for properly positioning and locking the luminaire ring member in its uppermost rest position as in the case of the instant invention. In addition, none of the devices of the prior art have a safety lock assembly such as that found in this invention.

Objects

It is therefore an object of this invention to provide a pole shaft having a luminaire ring assembly that is easily raised and lowered by use of suspension cables which are operatively connected to continuous loop drive chain means positioned within the pole shaft.

Another object of this invention is to provide a pole shaft having a detachable fixed head assembly at the top thereof which is provided with locating and locking means which fixedly engage the luminaire ring assembly in its fully raised position.

Yet another object of this invention is to provide a pole shaft having a luminaire ring assembly that is easily raised and lowered without the need of complicated and expensive winch and counterweight systems.

Another object of this invention is to provide a continuous loop drive chain means having transition plate assembly in association therewith which engages suspension cables that are connected to and support a luminaire ring.

Yet another object of this invention is to provide a safety lock assembly which is adapted to engage a safety cable so as to keep the luminaire ring from falling in the event of failure of the continuous loop drive chain.

A still further object of this invention is to provide a pole shaft having a continuous loop drive chain means for raising and lowering a luminaire ring assembly and which is actuated by a gear reducer drive assembly positioned in the base of the pole shaft.

Another object of this invention is to provide a gear reducer drive assembly within the base of a pole shaft which is powered by a built-in motor or by a portable external motor selectively coupled therewith.

Other objects and advantages found in the construction of the invention will be apparent from a consideration of the following specification in connection with the appended claims and the accompanying drawings.

In the Drawings

FIG. 6 is a partial exploded schematic view of the portable motor, motor mount anchor bracket and the motor drive coupling provided on the gear reducer assembly.

FIG. 7 is a partial schematic view showing an alternate form of the drive assembly with a built-in motor drive unit therebelow.

FIG. 8 is a partial cross-sectional schematic view of the transition plate and the safety lock assembly associated therewith.

FIG. 9 is a partial top cross-sectional schematic view of the transition plate assembly.

General Description

Figure 1:
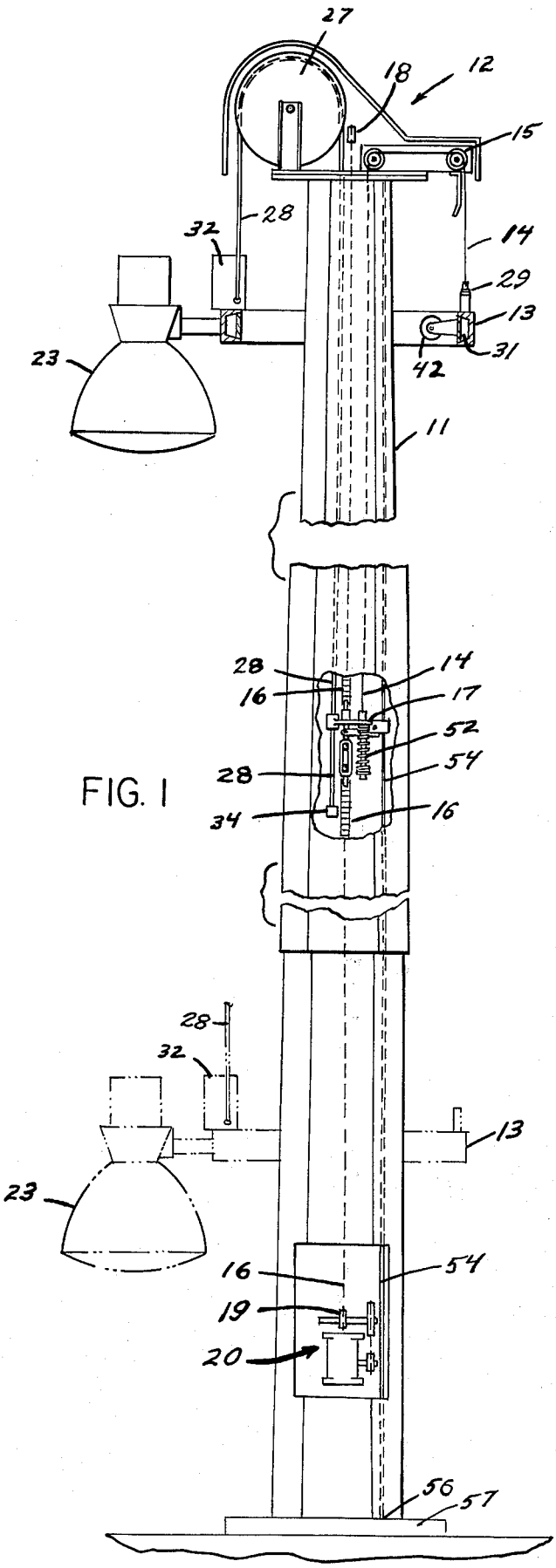
FIG. 1 is a front elevation schematic view of the pole shaft showing the continuous loop drive chain means and associated suspension cables which support, raise and lower the luminaire ring positioned thereon.

As shown in FIG. 1, a pole shaft 11 is provided having a detachable fixed head assembly 12 at the top thereof. A luminaire ring 13 is concentrically mounted on the pole shaft 11 by being suspended from the detachable head assembly 12 by a plurality of raising and lowering suspension cables 14. The suspension cables 14 pass over suspension cable sheaves 15 provided in the head assembly 12 and extend downwardly through the interior of the pole shaft 11 to fixedly engage continuous loop drive chain 16 through the transition plate 17 provided thereon. For purposes of clarity only, one of the suspension cables 14 are shown in FIG. 1.

The transition plate 17 is attached to the continuous loop drive chain 16 and is movable therewith. The continuous loop drive chain 16 passes over an upper idler drive chain sprocket 18 positioned on the head assembly 12 and is driven by the lower drive chain sprocket 19 forming a part of the drive assembly 20 located within the base of the pole shaft 11.

Figure 3:
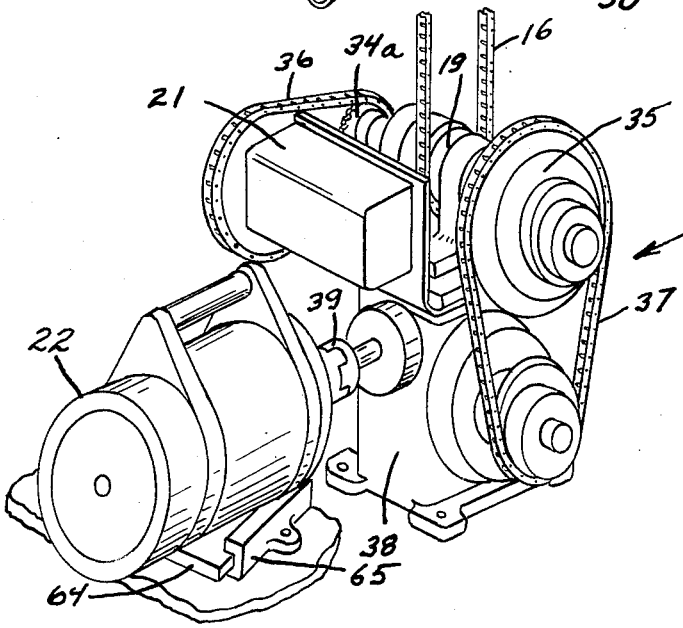
FIG. 3 is a perspective schematic view of the drive assembly positioned at the bottom of the pole shaft and showing a portion of the associated continuous loop drive chain and limit switch assembly connected thereto.

As shown in FIG. 3, the limit of travel of the continuous loop drive chain 16 is controlled by the limit switch assembly 21. The limit switch mechanism is of a mechanical gear type well known in the art and will not be discussed herein. It is within the scope of the invention that any type of limit switch means can be used to control the distance that the continuous loop drive chain 16 travels. The drive assembly 20 is powered by the portable motor 22. For purposes of clarity, the limit switch assembly 21 and the motor 22 are not shown in FIG. 1.

The drive assembly 20 can be actuated by the motor 22 so as to move the continuous loop drive chain 16 to draw the transition plate 17 downwardly. This downward movement in turn draws the suspension cables 14 which are attached to the transition plate 17 downwardly within the pole shaft 11. The luminaire ring 13 is thus drawn upwardly to its fully raised up position against the head assembly 12. The operation of the limit switch means 21 stops the travel of the continuous loop drive chain 16 when the luminaire ring 13 reaches its fully raised up position.

The luminaire ring 13 can be lowered to permit ground level servicing of the luminaires 23 and associated electrical and mechanical apparatus. The lowering of the luminaire ring is accomplished by actuating the drive assembly 20 so as to drive the continuous loop drive chain 16 in the opposite direction. The limit switch assembly 21 automatically stops the continuous loop drive chain 16 when the luminaire ring 13 is at its fully lowered position as shown in phantom-line in FIG. 1. When the ground servicing is completed, the continuous loop drive chain 16 is actuated so as to move the transition plate 17 downwardly so that the suspension cables 14 attached thereto lift the luminaire ring 13 to its fully raised operative use position.

Specific Description

More specifically, the pole shaft 11 is fabricated from a plurality of hollow metal tapered mating segments. The detachable fixed head assembly 12 which is positioned at the top of the pole shaft 11 as shown in FIG. 1 is shown in detail in the exploded schematic view of FIG. 2. The detachable head assembly 12 consists of three horizontally oriented radially extending support arms 24 mounted on a head mating plate 25. The head mating plate 25 is in turn mounted on the pole cap plate 26. Each of the support arms 24 are provided with two suspension cable sheaves 15 over which suspension cables 14 are suspended.

The luminaire ring 13 is movably suspended on the exterior of the pole shaft 11 as shown in FIG. 1. This is accomplished by the suspension cables 14 which are attached to suspension cable brackets 29 provided on the luminaire ring 13. The luminaire ring 13 is provided with a plurality of luminaire mounting stub outlets 30 for receiving luminaire elements 23 as shown in FIG. 1. The luminaire ring 13 is of hollow construction and contains a wiring raceway 31 therearound for providing electrical power to the luminaire stub outlets 30. An electrical power box 32 is provided on the luminaire ring 13 so as to receive the electrical conductor cable 28. The conductor cable 28 extends upwardly from power box 32, passes over the conductor cable sheave assembly 27 provided on the head mating plate 25 and extends downwardly into the interior of the pole shaft 11 into fixed engagement with the transition plate 17. The conductor cable 28 is fixedly retained against the transition plate 17 by the conductor cable retaining bracket 33. The conductor cable 28 extends downwardly below the transition plate 17 and terminates with plug 34 at the end thereof. As the transition plate 17 moves downwardly, the conductor cable 28 is drawn downwardly therewith. When the luminaire ring 13 reaches its fully up position, the conductor cable plug 34 is positioned near a socket (not shown) in the base of the pole shaft 11 and can be connected thereto so as to provide electricity to the luminaire ring 13. The plug 34 is disconnected when it is desired to lower the luminaire ring 13 for servicing.

An upper idler sprocket 18 is also provided on the head mating plate 25 so as to receive the continuous loop drive chain 16 thereover. The continuous loop drive chain 16 extends downwardly into the interior of the pole shaft 11 through centrally positioned openings provided in the head mating plate 25 and the pole cap plate 26.

As shown in FIG. 3, the continuous loop drive chain 16 engages the drive chain sprocket 19 provided on the drive assembly 20 which is located within the base of the pole shaft 11. The continuous loop drive chain sprocket 19 is driven by sprocket clutch assembly 35. The limit switch drive chain sprocket 34a is also fixedly attached to the same shaft as the continuously loop drive chain sprocket 19 and is thus also driven by the sprocket clutch assembly 35. The limit switch drive chain 36 engages and actuates the limit switch assembly 21 as shown schematically in FIG. 3.

The clutch assembly drive chain 37 is driven by the worm gear reducer assembly 38. The worm gear reducer assembly 38 can be powered by the portable drive motor 22 which engages the motor drive coupling 39 provided on the worm gear reducer assembly 38.

As shown in FIG. 7, an alternate method of driving the worm gear reducer assembly 38 is to provide a built-in motor drive 40 which drives the worm gear drive chain or belt 41.

Figure 2:
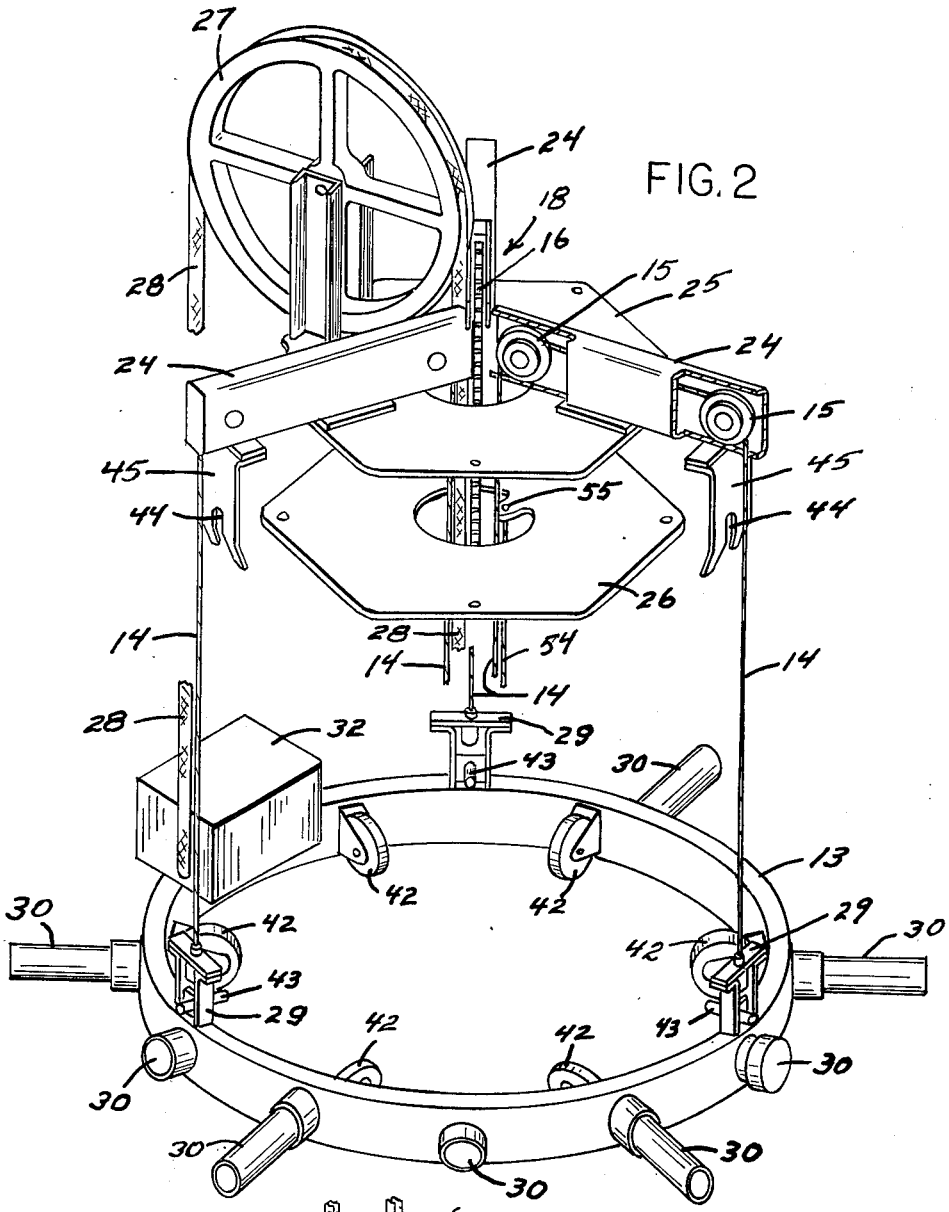
FIG. 2 is a perspective schematic view of the detachable fixed head assembly provided at the top of the pole shaft and showing the relative positioning of the continuous loop drive chain, conductor cable, suspension cables and luminaire ring supported thereby.

As shown in FIG. 2, the luminaire ring 13 is provided six equally spaced protective guide rollers or bumpers 42 extending inwardly therefrom. The protective rollers 42 are adapted to engage the outer surface of the pole shaft 11 so as to prevent the luminaire ring from striking the pole shaft 11 as it is being raised and lowered when there are winds causing side or swinging movement of the luminaire ring 13 thereagainst.

The luminaire ring 13 is provided with locator pins 43 which are adapted to engage locator pin slots 44 provided in the locator pin brackets 45 which are mounted on each of the support arms 24 provided on the fixed head assembly 12. As the luminaire ring 13 moves into the fully raised up position against the fixed head assembly 12, the locator pins 43 engage the locator pin slots 44 so as to retain the luminaire ring 13 against vertical or rotational movement as will hereinafter be explained.

Figure 4:
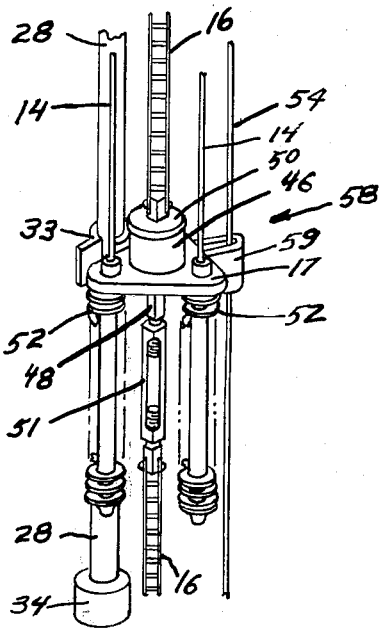
FIG. 4 is a partial perspective schematic view of the transition plate assembly and of the continuous loop drive chain, suspension cables, conductor cable and safety cable in association therewith.

As shown in FIGS. 4, 8 and 9, the transition plate 17 is provided with a centrally positioned upwardly extending hollow cylindrical extension 46 in which compression spring 47 is freely positioned. A drive chain connector shaft 48 is slidably positioned with a centrally positioned hole 49 provided through the transition plate 17.

Figure 5:
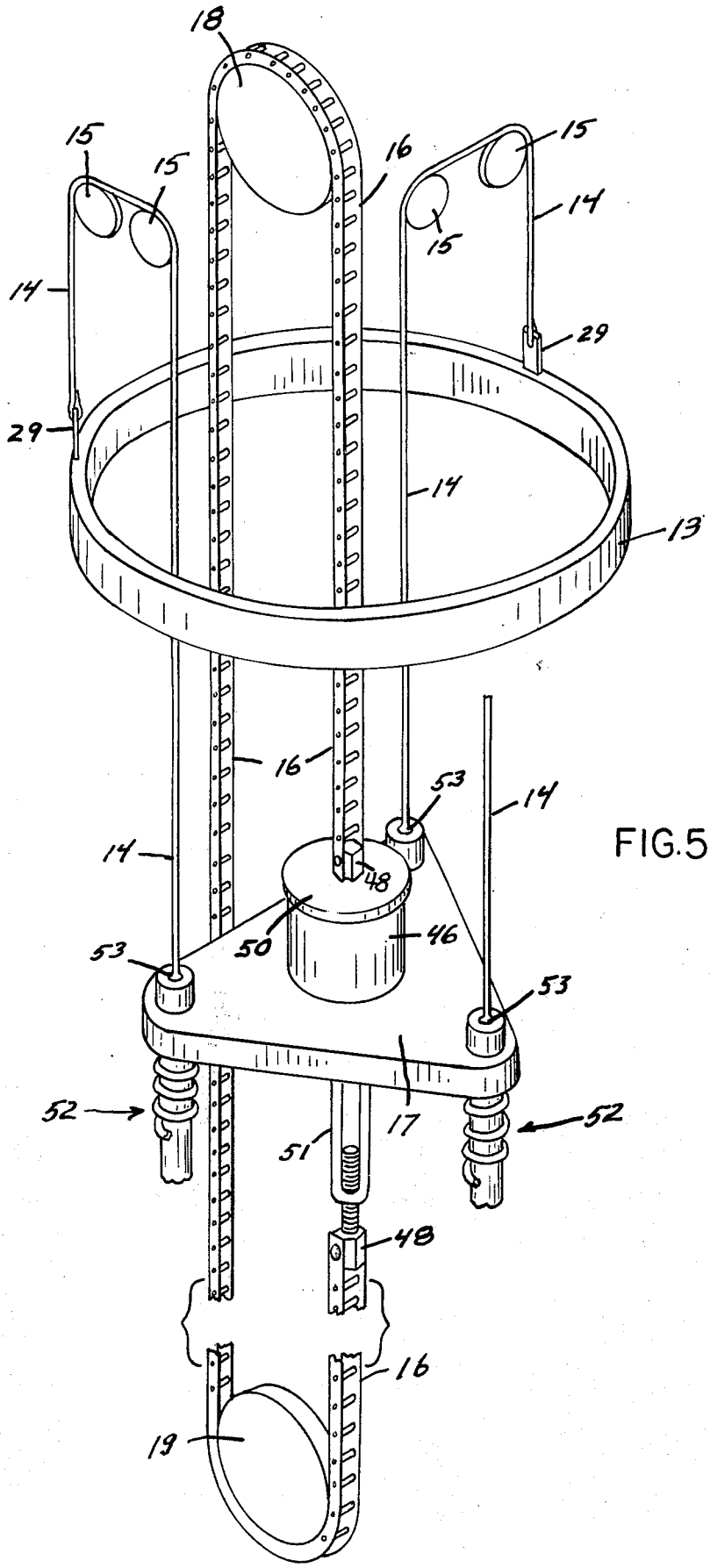
FIG. 5 is a simplified perspective schematic view showing the interrelationship between the transition plate, the continuous loop drive chain, the suspension cables and the luminaire ring attached thereto.

The upper end of the connector shaft assembly 48 extends upwardly through the hollow cylindrical extension 46 and fixedly engages the continuous loop drive chain 16. A horizontal cover plate 50 is fixedly attached proximate to the upper end of the connector shaft 48. The cover plate 50 freely abuts against the open end of cylindrical extension 46 and compressibly retains the compression spring 47 therein when the continuous loop drive chain 16 is in its normal operative use position as schematically shown in FIGS. 1, 5 and 8.

The lower end of the connector shaft assembly 48 is fixedly attached to the opposite end of the drive chain 16. A turnbuckle 51 is provided as a part of the connector shaft 48 so that the desired amount of tension can be imparted to the continuous loop drive chain 16 so as to maintain it in its operative use position around the upper drive chain idler sprocket 18 and the lower drive chain drive sprocket 19.

As shown in FIGS. 1, 4, 5 and 9, the suspension cables 14 are attached to the transition plate 17 by use of spring loaded suspension cable retainer assemblies 52. The suspension cables 14 pass through openings 53 provided in the transition plate 17 and engage the spring loaded suspension cable retainer assemblies 52 positioned therebelow.

The spring—loaded attachment of the suspension cables 14 to the transition plate 17 equalizes the load on each suspension cable 14. Further, when the luminaire ring 13 is raised to its full up position against the fixed head assembly 12 with the locator pins 43 positioned in the locator pin slots 44, the continuous loop drive chain 16 continues to move so as to place a post load on the spring load suspension cable retainer assemblies 52. This additional pressure provides an additional positive locking force which securely retains the luminaire ring 13 in its fully raised position against the fixed head assembly 12.

A safety cable 54 is provided inside of the pole shaft 11 and extends vertically for the entire length thereof. At the upper end thereof, the safety cable 54 is attached to the pole cap plate 26 at opening 55. At the lower end thereof, the safety cable 54 is attached at point 56 to the base 57 of the pole shaft 11.

As shown in FIGS. 4, 8 and 9, a safety lock assembly 58 is incorporated into the transition plate 17. The safety lock assembly 58 comprises a U-shaped housing 59 which extends outwardly from the transition plate 17. The safety cable 54 extends freely downwardly through the U-shaped housing 59. As the transition plate 17 moves upwardly and downwardly within the pole shaft 11, the U-shaped housing 59 travels along the stationary safety cable 54 but does not normally come into contact therewith. A safety brake arm 60 is pivotally mounted within the U-shaped housing 59 by pivot pin 61 so that the operative outer braking surface 62 thereof is normally in a parallel spaced-apart relationship with the safety cable 54. The opposite end of the safety brake arm 60 is connected to the connector shaft 48 by connector shaft pin 63. In the event of a malfunction whereby the drive chain 16 breaks, the corresponding decrease of normal drive chain tension force causes the connector shaft 48 to automatically move upwardly in response to the upward pressure of the compression spring 47 against the cover plate 50. This movement causes the safety brake arm 60 to pivot clockwise about the pivot pin 61 so that the braking surface 62 of the brake arm 60 lockably clamps against the safety cable 54. The transition plate 17 is thus secured against any accidental movement or release thereby preventing the luminaire ring 13 from falling to the ground due to failure of the continuous loop drive chain system. When drive chain 16 is fixed and normal drive chain tension is restored, the connector shaft 48 moves downwardly in response to such drive chain tension or back pressure thereby compressing the compression spring 47 within the housing extension 46. Thus, the safety brake arm 60 is pivoted counterclockwise so as to disengage the braking surface 62 from the safety cable 54 so as to permit free movement of the transition plate 17 therealong in response to corresponding selected movement of the continuous loop drive chain 16.

In operation, the luminaire ring 13 is selectively raised and lowered by corresponding movement of the continuous loop drive chain 16. This is best shown in the schematic presentation of FIG. 5. If it is desired to lower the luminaire ring 13, the continuous loop drive chain 16 is selectively driven by the drive sprocket 19 so as to raise the transition plate 17 which is fixedly incorporated thereinto. For purposes of clarity, the transition plate 17 is presented only in a schematic manner in FIG. 5 and does not show the associated safety lock assembly 58. As the transition plate 17 moves upwardly, the suspension cables 14 which are fixedly connected thereto also move upwardly and over the sheaves 15, thereby causing the luminaire ring 13 to be lowered. The luminaire ring 13 is raised by reversing the direction of travel of the continuous loop drive chain 16. As the transition plate 17 is moved downwardly, it draws the suspension cables 14 downwardly therewith. This corresponding downward movement of suspension cables 14 within the pole shaft 11 causes the luminaire ring 13 to be lifted to its fully raised operative use position on the exterior of the pole shaft 11, as shown in FIG. 1.

As shown in FIGS. 3 and 6, the portable motor 22 is provided with a dagger anchor positioning plate 64 which is adapted to engage an anchor plate positioning bracket 65 so that motor shaft 66 is aligned with and engages the motor coupling 39.

It is thus seen that a unique luminaire ring raising and lowering device is provided which utilizes a continuous loop drive chain 16 to selectively raise and lower a luminaire ring operatively connected thereto by suspension cables 14. The suspension cables are connected at one end thereof to a transition plate attached to the continuous loop drive chain 16. The suspension cables 14 then extend upwardly within the pole shaft and down the exterior of the pole shaft to engage the luminaire ring 13 at the opposite ends thereof. Thus, corresponding movement of the transition plate 17 by the continuous loop drive chain 16 causes the suspension cables 14 attached thereto to raise and lower the luminaire ring 13 accordingly.

Various other modifications of the invention may be made without departing from the principle thereof. Each of the modifications is to be considered as included in the hereinafter appended claims, unless these claims by their language expressly provide otherwise.

I claim:

1. In an apparatus for raising and lowering a luminaire ring on a pole shaft, the combination including:

a continuous loop drive chain positioned within a pole shaft, said continuous loop drive chain extending approximately the entire length of said pole shaft;

a transition plate fixedly attached and enclosing said continuous loop chain so as to selectively move upwardly and downwardly in response to corresponding movement of said drive chain;

suspension cable means connected at one end to said transition plate, said suspension cable means extending upwardly within said pole shaft to the exterior thereof;

a luminaire ring attached to the opposite ends of said suspension cable means on the exterior of said pole shaft, said luminaire ring being selectively raised and lowered along said pole shaft in response to corresponding movement of said suspension cable means.

2. In the apparatus of claim 1 wherein motor drive means are provided to selectively drive said continuous loop drive chain in either direction.

3. In the apparatus of claim 1 wherein said transition plate adapted to attachably retain the end of said suspension cable means under spring tension.

4. In the apparatus of claim 1 wherein limit switch means are provided to control the amount of travel of the continuous loop drive chain in either direction.

5. In the apparatus of claim 1 wherein a fixed head assembly is provided at the top of the pole shaft, said fixed head assembly provided with radially extending support arms each having a pair of sheaves which movably support said suspension cable means thereover.

6. In the apparatus of claim 5 wherein a conductor cable is connected to a power box provided on said luminaire ring, said conductor cable adapted to pass over a conductor cable sheave provided on said fixed head assembly so as to extend downwardly into fixed engagement with said transition plate.

7. In the apparatus of claim 2 wherein a worm gear reducer assembly is provided intermediate said continuous loop drive chain and said motor drive means.

8. In the apparatus of claim 7 wherein portable motor drive means are provided having a dagger anchor positioning plate which is adapted to engage an anchor plate positioning bracket provided on the pole shaft.

9. In an apparatus for raising and lowering a luminaire ring on a pole shaft, the combination including:

a continuous loop drive chain positioned within a pole shaft, said continuous loop drive chain extending approximately the entire length of said pole shaft;

a transition plate fixedly provided on said continuous loop drive chain so as to selectively move upwardly and downwardly within said pole shaft in response to corresponding movement of said drive chain;

suspension cable means connected at one end to said transition plate, said suspension cable means extending upwardly within said pole shaft to the exterior thereof;

a luminaire ring attached to the opposite ends of said suspension cable means on the exterior of said pole shaft, said luminaire ring being selectively raised and lowered along said pole shaft in response to corresponding movement of said suspension cable means; and a U-shaped extension member is provided on said transition plate, said U-shaped extension member adapted to freely receive a safety cable therethrough which extends the length of the pole shaft, said U-shaped extension member having a pivotally mounted spring biased normally open braking arm provided thereon, said braking arm adapted to clampably engage said safety cable upon failure of said continuous loop drive chain.

* * * * *